US008163187B2

(12) United States Patent
Abo et al.

(10) Patent No.: US 8,163,187 B2
(45) Date of Patent: Apr. 24, 2012

(54) PROCESS OF PRODUCING LIQUID DISCHARGE HEAD

(75) Inventors: Hiroyuki Abo, Tokyo (JP); Masaki Ohsumi, Yokosuka (JP); Toshiyasu Sakai, Kawasaki (JP); Noriyasu Ozaki, Atsugi (JP); Mitsuru Chida, Yokohama (JP); Kazuya Abe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 539 days.

(21) Appl. No.: 12/478,602

(22) Filed: Jun. 4, 2009

(65) Prior Publication Data

US 2009/0302502 A1 Dec. 10, 2009

(30) Foreign Application Priority Data

Jun. 5, 2008 (JP) ..... 2008-148131

(51) Int. Cl.
*B41J 2/05* (2006.01)

(52) U.S. Cl. ..... 216/27; 430/320; 430/311; 347/20

(58) Field of Classification Search ..... 216/27; 430/320, 311; 347/20
See application file for complete search history.

(56) References Cited

U.S. PATENT DOCUMENTS

| | | | | |
|---|---|---|---|---|
| 5,458,254 | A * | 10/1995 | Miyagawa et al. | 216/27 |
| 6,390,606 | B1 * | 5/2002 | Terui et al. | 347/63 |
| 2007/0178248 | A1 * | 8/2007 | Ohsumi et al. | 427/555 |
| 2007/0207414 | A1 * | 9/2007 | Murayama et al. | 430/311 |

* cited by examiner

*Primary Examiner* — Lan Vinh
*Assistant Examiner* — David Kaufman
(74) *Attorney, Agent, or Firm* — Canon USA Inc IP Division

(57) ABSTRACT

Provided is a process of producing a liquid discharge head having a substrate, a passage-forming member, and a patterned layer. The process includes providing a resin layer on a substrate; providing a resist pattern on the resin layer for patterning the resin layer; forming a patterned layer by patterning the resin layer using the resist pattern as a mask; providing a layer for forming a passage pattern having a shape of passage on the resist pattern lying on the patterned layer; forming a passage pattern by patterning the layer for forming a passage pattern; removing the resist pattern; providing a passage-forming member so as to cover the passage pattern and the patterned layer; and removing the passage pattern to give the passage.

5 Claims, 2 Drawing Sheets

PROCESS OF PRODUCING LIQUID DISCHARGE HEAD

BACKGROUND OF THE INVENTION

1. Field of the Invention

The present invention relates to a liquid discharge head for discharging a liquid and a process of producing the liquid discharge head. More specifically, the invention relates to a process of producing a liquid discharge recording head for conducting recording by discharging, for example, an ink to a recording medium.

2. Description of the Related Art

An ink jet recording head is known as a liquid discharge head for conducting recording by ejecting droplets from discharge ports. In some ink jet recording heads, foams are formed by a liquid overheated by receiving thermal energy, and droplets are discharged from the discharge ports of the ink jet recording head by the effort of this generation of foams. The discharged droplets adhere to a recording member to record information. Such an ink jet recording head includes an ink-discharge-energy-generating unit for generating ink discharge energy disposed on a substrate; an upper protection layer for protecting the ink-discharge-energy-generating unit from ink; and a lower layer for storing heat. When the ink discharge energy is heat, the ink-discharge-energy-generating unit is usually a heating element.

Furthermore, the ink jet recording head includes a coating resin layer serving as a passage wall constituting a passage, and this passage wall is provided with discharge ports.

A method of producing the above-described ink jet recording head is disclosed in U.S. Pat. No. 6,390,606.

In the method described in U.S. Pat. No. 6,390,606, a positive photosensitive resin layer is formed on a contact layer made of resin provided on a substrate, and a pattern having a shape of passage is formed by patterning the positive photosensitive resin layer. Furthermore, a negative photosensitive resin layer serving as a passage-forming member is formed on the upside of the positive photosensitive resin layer and the contact layer. Discharge ports are formed in the negative photosensitive resin layer, and the pattern having a shape of passage is removed to complete the formation of the passage.

In the method described in U.S. Pat. No. 6,390,606, when the positive photosensitive resin layer is provided on the contact layer, materials for these layers have to be selected such that the positive photosensitive resin layer does not damage the contact layer, so that the reliability of the adhesion of the control layer with the passage-forming member may not be affected by the damage. Therefore, the selection of a material for the positive photosensitive resin layer or the contact layer will be regulated.

SUMMARY OF THE INVENTION

The present invention has been made in consideration of the above problems and provides a process of producing a liquid discharge head having a contact layer between a substrate and a passage-forming member, where the reliability of the adhesion of the contact layer with the passage-forming member is increased.

An aspect of the present invention provides a process of producing a liquid discharge head including a substrate, a passage-forming member for forming a passage that communicates with discharge ports for discharging a liquid, and a patterned layer that is made of a resin disposed between the passage-forming member and the substrate so as to be in contact with the passage-forming member and the substrate and has a pattern corresponding to the shape of the passage-forming member. The process includes providing a resin layer on a substrate; providing a resist pattern on the resin layer for patterning the resin layer; forming a patterned layer by patterning the resin layer using the resist pattern as a mask; providing a layer for forming a passage pattern having a shape of passage on the resist pattern lying on the patterned layer; forming a passage pattern by patterning the layer for forming a passage pattern; removing the resist pattern; providing a passage-forming member so as to cover the passage pattern and the patterned layer; and removing the passage pattern to give the passage.

Further features of the present invention will become apparent from the following description of exemplary embodiments with reference to the attached drawings.

DESCRIPTION OF THE EMBODIMENTS

Figure 1A:
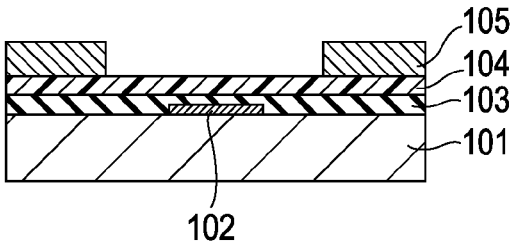
FIGS. 1A to 1H are cross-sectional views schematically illustrating a process of producing a liquid discharge head according to an embodiment of the present invention.

The liquid discharge head can be mounted on apparatuses such as a printer, a copier, a facsimile machine having a communication system, and a word processor having a printer and further on industrial recording apparatuses combined in complex manner with various processing apparatuses. The use of this liquid discharge head allows recording on various types of recording media such as paper, thread, fiber, textile, leather, metal, plastic, glass, wood, and ceramic. The term "recording" used in this specification includes not only forming an image having a specific meaning, such as letters and figures, but also forming an image not having a specific meaning, such as a pattern.

The term "ink" or "liquid" should be broadly interpreted and includes a liquid that forms an image, a figure, a pattern, or the like by being applied on a recording medium and a liquid that is used for processing a recording medium or treating an ink or a recording medium. The treatment of an ink or a recording medium means, for example, improvement of fixability by solidification or insolubilization of coloring material in an ink applied on a recording medium, improvement of recording quality and color developability, and improvement of image durability.

The present inventors have focused attention on that the etching mask (hereinafter, referred to as mask) for forming an adhesion-improving layer is made of a first positive photoresist. In the first positive photoresist, the resist region remaining as a mask is an unexposed region. In hitherto known methods, this resist region is removed after etching. However, in the present invention, since the mold member is made of a second positive photoresist, the region where the mold member is formed is an unexposed region.

The region where the mold member is formed is inside a region surrounded by the adhesion-improving layer and is not in contact with the adhesion-improving layer (contact layer).

In such a case, exposure of the second positive photoresist serving as the mold member is carried out such that the region where the mold member is formed is shielded from light. It has been consequently revealed that the region where the adhesion-improving layer will be formed is a region to be exposed and the first positive photoresist serving as a mask is exposed when the mold member is formed, even if the first positive photoresist serving as a mask remains.

Accordingly, the present inventors have found the fact that roughness of the surface of an adhesion-improving layer is decreased by forming a second positive photoresist film for forming a mold member and conducting exposure and development without removing a photoresist serving as an etching mask.

The first positive photoresist film serving as a mask and the second positive photoresist film serving as a mold member may be made of the same material or different materials, but it is preferred that the material for the first positive photoresist film serving as a mask have a photosensitive wavelength range that includes the exposure wavelength for the second positive photoresist film serving as a mold member. That is, when the first positive photoresist serving as a mask has a photosensitive wavelength range including the exposure wavelength for the second positive photoresist film serving as a mold member, the first positive photoresist film is also exposed when the second positive photoresist film is exposed and can be removed by developing the portion received the exposure.

A liquid discharge recording head as an example of the liquid discharge head produced by the process of the present invention has discharge ports, discharge-energy-generating elements for discharging a liquid from the discharge ports, and a passage wall for forming a passage communicating with the discharge ports. The liquid discharge recording head will be described with reference to FIG. 2 showing an embodiment of the head.

Figure 2:
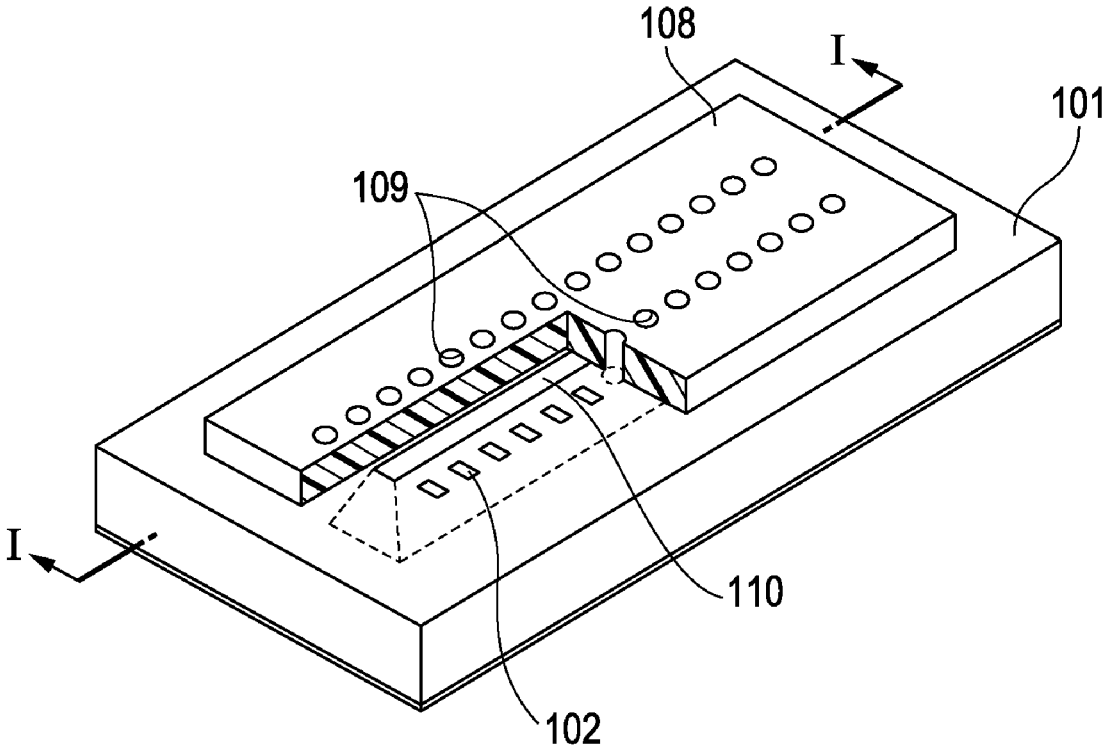
FIG. 2 is a perspective view schematically illustrating a liquid discharge head according to an embodiment of the present invention.

FIG. 2 is a perspective view schematically illustrating a liquid discharge recording head as an example of the liquid discharge head. In this liquid discharge recording head, two lines of discharge-energy-generating elements 102 are arranged at predetermined intervals on a silicon substrate 101 having a polyetheramide layer (not shown) serving as the adhesion-improving layer thereon. Furthermore, a coating resin layer 108 made of a hardened photosensitive resin forms a passage wall that is provided with discharge ports (liquid discharge ports) 109 opening on the upside of the discharge-energy-generating elements 102 on the substrate 101. Thus, a passage (not shown) that connects a common liquid supply port 110 to each discharge port 109 is formed.

In addition, the common liquid supply port 110 formed by anisotropic etching of silicon opens between the two lines of the discharge-energy-generating elements 102. In this liquid discharge recording head, droplets are discharged from the discharge ports 109 by applying a pressure due to energy generated by the discharge-energy-generating elements 102 to a liquid in the passage through the common liquid supply port 110, and the discharged droplets adhere on a recoding medium. Thus, recording is carried out.

Next, an embodiment of the process according to the present invention will be described with reference to views of partial cross sections of a unit portion where one discharge-energy-generating element is formed. The cross sections are perpendicular to the substrate, and the discharge-energy-generating element has the configuration shown in FIG. 2.

Embodiments

The process of producing the liquid discharge recording head will be described in detail with reference to FIGS. 1A to 1H schematically illustrating the process by partial cross sections taken along the line I-I of FIG. 2.

A substrate 101 having discharge-energy-generating elements 102 on the surface thereof is provided with a protection film 103 made of a silicon-based insulating film such as a silicon oxide film or a silicon nitride film such that the protection film 103 covers the discharge-energy-generating elements 102. The protection film 103 protects the discharge-energy-generating elements 102 from ink and also has a function for storing energy (heat) from the discharge-energy-generating elements 102.

A polyetheramide resin is applied on the front surface and the rear surface of the substrate 101 by, for example, spin coating, and the resulting coatings are cured by baking to form adhesion-improving layers 104 having a thickness of 2 μm. The material for the adhesion-improving layers 104 may be any material that has alkaline resistance and intermolecularly binding effect and further has an effect for dispersing stress that is generated when a coating resin layer 108 shown in FIG. 1F is stacked or fabricated.

The adhesion-improving layers 104 are necessarily provided at least at a position where a passage wall will be formed.

Here, the surface of the substrate 101 on the side where the discharge-energy-generating elements 102 are disposed is defined as the front surface, and the surface of the substrate 101 on the opposite side of the side where the discharge-energy-generating elements 102 are disposed is defined as the rear surface.

In FIGS. 1A to 1H, the film of the polyetheramide resin formed on the rear surface is not shown. This polyetheramide resin film is used as a mask when a liquid supply port 110, which is described below, is formed. This mask can be formed, for example, as follows: First, a polyetheramide resin film is formed on the rear surface of the substrate. A positive photoresist is applied on the polyetheramide resin film and is subjected to patterning exposure and development to form a mask for patterning the polyetheramide resin film. The polyetheramide resin film is patterned using this mask by, for example, dry etching. Then, the mask is removed. A mask for forming a common liquid supply port 110 is formed. The resist used for the mask is preferably a novolac resin.

On the other hand, on the front surface of the substrate, a polyetheramide resin film 104 and a first positive photoresist film having a thickness of 7 μm are stacked in this order. The first positive photoresist film is formed by applying THMR-iP5700HP (manufactured by Tokyo Ohka Kogyo Co., Ltd.) on the resin film 104 by, for example, spin coating. Then, the first positive photoresist film is patterned by exposure in an exposure amount of 3000 mJ and development so as to give an etching mask 105 (see FIG. 1A) having a shape corresponding to the adhesion-improving layer. The development is carried out using methylisobutylketone.

Furthermore, it is preferred to use the same material for the positive photoresists serving as the masking members of the front and rear surfaces, which is advantageous because the development can be conducted under the same conditions.

Figure 1B:
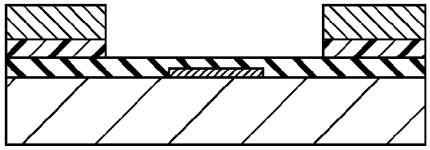
Figure 1C:
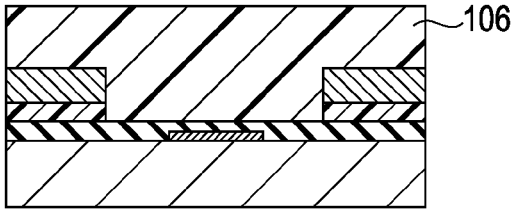

Then, the resin film 104 is patterned by, for example, chemical dry etching into a shape corresponding to the shape (the bottom of passage wall) of the substrate side of the passage-forming member (see FIG. 1B).

Figure 1D:
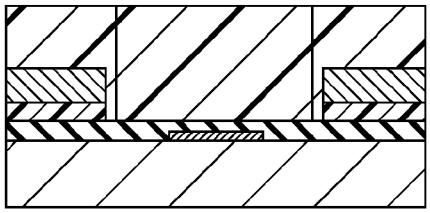
Figure 1E:
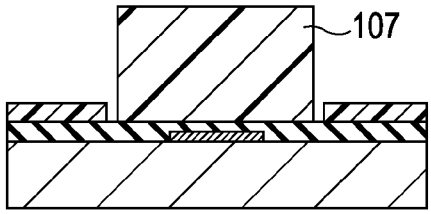
Figure 1F:
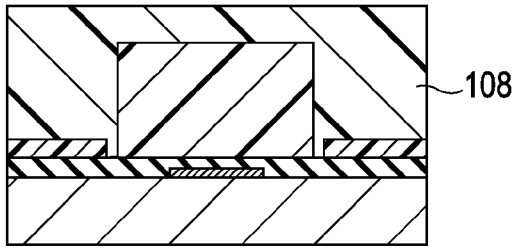
Figure 1G:
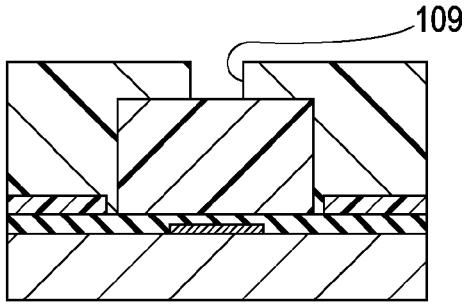
Figure 1H:
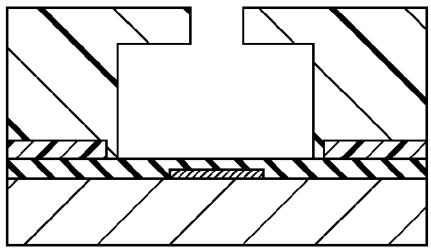

Then, a second positive photoresist film 106 having a thickness of 14 μm is formed, without removing the etching mask 105, by application of a polymethylisopropenylketone (ODUR-1010A: manufactured by Tokyo Ohka Kogyo Co., Ltd.) in a cyclohexanone solvent by, for example, spin coating (see FIG. 1C) and exposure in an exposure amount of 24000 mJ (see FIG. 1D). The solvent used for the coating is cyclohexanone. Then, an exposure portion of the second positive photoresist film 106 and the etching mask 105 are removed by developing the exposure portion of the second positive photoresist film 106 to form a mold member 107 as a passage pattern occupying a region that will become a passage. Thus, the adhesion-improving layer 104 is exposed (see FIG. 1E).

The exposure of the second positive photoresist film 106 is carried out under the state that a region that is allowed to remain as the mold member 107 is shielded from light. That is, this exposure is carried out such that the portion of the second positive photoresist film 106 where becomes the mold member is used as a light-shielding portion and the etching mask 105 on the adhesion-improving layers 104 is exposed. The portion exposed is removed by development to give the mold member 107. As a result, since the first positive photoresist remaining as the etching mask 105 is also exposed, the etching mask 105 is also developed when the second positive photoresist film 106 is developed and is thereby removed. The development is carried out using a mixture liquid of methylisobutylketone. The positive photoresist serving as the masking material is subjected to baking for a period of time that is two times that of usual treatment, but since the exposure of the positive photoresist 106 is carried out with an exposure amount that is seven or more times that of usual exposure, the positive photoresist can be easily removed by development.

The region left as the mold member 107 can be inside a region surrounded by the adhesion-improving layer 104 and not in contact with the adhesion-improving layer 104.

Then, a coating resin layer 108 having a thickness of 11 μm is formed as a negative photoresist containing an epoxy resin by, for example, spin coating (see FIG. 1F). Then, the coating resin layer 108 is exposed and developed to form a discharge port 109 (see FIG. 1G). The region cured by the exposure serves as the passage wall. The contact layer (adhesive-improving layer) 104 is covered by the passage wall and is not exposed.

Furthermore, on the coating resin layer 108, a water repellent material may be applied, for example, in a form of a water repellent layer.

Then, the front surface and the side surfaces of the substrate 101 are covered with a protection material by, for example, spin coating. The protection material prevents scratches from being formed during transportation between devices and is sufficiently resistive to strong alkaline solution used for anisotropic etching. Accordingly, degradation of, for example, the water repellent material due to alkaline wet etching can be prevented. After the coating of the front surface and the side surfaces with the protection material, a common liquid supply port (see FIG. 2) that reaches the mold member 107 is formed by alkaline wet etching using the etching mask provided on the rear surface of the substrate 101.

Then, the protection material is removed. The mold member 107 is eluted from the common liquid supply port using methyl lactate having a liquid temperature of 40° C. under application of ultrasound with a frequency of 200 kHz and a sound pressure of 30 mV or more to form a passage defined by the passage wall and the surface of the substrate (see FIG. 1H). When the discharge-energy-generating element is a heater, the passage functions as a foam-generating chamber, and a liquid is discharged from the discharge port 109 using the pressure of the foams generated when the liquid contained in the passage is heated with the heater. The mold member 107 can be removed by development from the common liquid supply port side of the rear surface of the substrate after the entire exposure of the mold member 107. After the development treatment, washing and drying are performed. During the development, ultrasonic immersion may be performed according to need.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-148131 filed Jun. 5, 2008, which is hereby incorporated by reference herein in its entirety.

What is claimed is:

1. A process of producing a liquid discharge head including a substrate, a passage-forming member for forming a passage that communicates with a discharge port for discharging a liquid, and a patterned layer that is made of a resin disposed between the passage-forming member and the substrate so as to be in contact with the passage-forming member and the substrate and has a pattern corresponding to the shape of the passage-forming member, the process comprising:

providing a resin layer on a substrate;

providing a resist pattern on the resin layer for patterning the resin layer;

forming a patterned layer by patterning the resin layer using the resist pattern as a mask;

providing a layer for forming a passage pattern having a shape of passage on the resist pattern lying on the patterned layer;

forming a passage pattern by patterning the layer for forming a passage pattern;

removing the resist pattern;

providing a passage-forming member so as to cover the passage pattern and the patterned layer; and removing the passage pattern to give the passage.

2. The process according to claim 1, wherein the resin layer is made of polyetheramide.

3. The process according to claim 1, wherein the layer for forming a passage pattern contains polymethylisopropenylketone and cyclohexanone.

4. The process according to claim 1, wherein the passage pattern is formed at a position spaced from the patterned layer.

5. A process of producing a liquid discharge head including a substrate, a passage-forming member for forming a passage that communicates with a discharge port for discharging a liquid, and a patterned layer that is made of a resin disposed between the passage-forming member and the substrate so as to be in contact with the passage-forming member and the substrate and has a pattern corresponding to the shape of the substrate side of the passage-forming member, the process comprising:

providing a resin layer on a substrate;

providing a resist pattern on the resin layer for patterning the resin layer;

forming a patterned layer by patterning the resin layer using the resist pattern as a mask;

providing a photosensitive resin layer on the resist pattern lying on the patterned layer;

exposing the photosensitive resin layer to form a pattern having a shape of the passage;

removing a portion of the photosensitive resin layer on the patterned layer so that a portion remains corresponding to the pattern, and removing of the resist pattern, simultaneously;

providing a passage-forming member so as to cover the passage pattern and the patterned layer; and removing the passage pattern to give the passage.

* * * * *